United States Patent [19]

Reini

[11] Patent Number: 4,544,008

[45] Date of Patent: Oct. 1, 1985

[54] LOG LIFTER FOR LOG SPLITTER

[76] Inventor: Donald N. Reini, W322 S1743 Moraine View Dr., Delafield, Wis. 53018

[21] Appl. No.: 590,455

[22] Filed: Mar. 16, 1984

[51] Int. Cl.[4] ..... B27L 7/00

[52] U.S. Cl. ..... 144/193 A; 144/366; 414/546; 414/557; 414/685

[58] Field of Search ..... 144/193 A, 193 R, 194, 144/366, 3 K; 414/16, 546, 552, 557, 680, 685

[56] References Cited

U.S. PATENT DOCUMENTS 3,862,651 1/1975 Heikkinen ..... 144/193 A
3,889,827 6/1975 Fine ..... 414/557
4,405,279 9/1983 Davy et al. ..... 414/546
4,431,362 2/1984 Wech, Jr. et al. ..... 144/193 A

*Primary Examiner*—W. D. Bray
*Attorney, Agent, or Firm*—Fuller, House & Hohenfeldt

[57] ABSTRACT

A log lifter for a log splitting machine enables logs to be fed to the splitting station without having to manually lift the log head. The log lifter comprises a frame pivotally connected to a conventional log splitting machine. The frame is raised by a hydraulic cylinder until the log rolls to the splitting station. A valve allows the log lifter to be raised and lowered in synchronization with the splitting cycle, thereby enabling a log to be automatically fed to the splitting station after a previous log has been split and while the splitting cylinder is retracting.

5 Claims, 3 Drawing Figures

1
7
9
13
15
17
19
21
23
25
26
27
28
29
30
31
33
35
36
38
40
43
45
47
51
53
55
57
59
67
79
85
87
3
5

25
26
28
81
33
43
47
45
35
85
37
39
36
57
38
49
53
40
31
3
79
59
87
51
63
67
69
65
77
75
61

21
23
19
17
87
76
87a
59
65
79
15
13
74
9
M
P
11
73
71

LOG LIFTER FOR LOG SPLITTER

BACKGROUND OF THE INVENTION

1. Field of the Invention

This invention pertains to work handling apparatus, and more particularly to apparatus for automatically feeding logs to a log splitting machine.

2. Description of the Prior Art

Various equipment has been developed for feeding logs to log splitters. Examples of prior log feeding devices are disclosed in U.S. Pat. Nos. 3,974,867; 4,076,061; 4,281,697; and 4,371,019. The log feeders disclosed in U.S. Pat. Nos. 3,974,867; 4,281,697; and 4,371,019 consist essentially of conveyors which feed the logs to the splitting station in a direction transverse to the direction of splitting motion. The log handling device of U.S. Pat. No. 4,076,061 employs a conveyor and winch for feeding the logs parallel to the direction of splitting motion. It is readily apparent that the machinery of the U.S. Pat. No. 4,076,061 is complicated and expensive and is of only limited application.

To increase productivity, it is desirable to automatically feed the unsplit logs to the splitting device in timed relationship to the splitting cycle. This may be accomplished, for example, by an intermittently moving conveyor, as illustrated in U.S. Pat. No. 4,371,019, or by rotatable crescent-shaped arms as shown in U.S. Pat. No. 4,281,697. The conveyor of U.S. Pat. No. 3,974,867 includes stops and lifting wings with hinged fingers thereon to feed logs from an elevated downwardly sloped conveyor to the splitting station.

A deficiency of the conveyor mechanism of U.S. Pat. Nos. 3,974,867; 4,281,697; and 4,371,019 is the lack of suitable devices for lifting the unsplit logs from the ground and onto the conveyors. As is well known, unsplit logs can be very heavy, and lifting large numbers of them onto a log splitter conveyor is a fatiguing task. Further, the exposed moving conveyor chains or other parts are sources of danger to persons operating the log splitter.

A further handicap of the previous devices is the complexity and costliness of the log feeder control systems. For example, U.S. Pat. No. 3,974,867 teaches a three-valve arrangement for operating the log splitting machinery; each valve must be operated in proper sequence by the operator for proper functioning of the log splitter. U.S. Pat. No. 4,371,019 also teaches separate valves for actuating the splitting mechanism and the conveyor.

Thus, a need exists for inexpensive and efficient log handling machinery which automatically feeds logs to a log splitting machine without requiring manual lifting of the log from the ground.

SUMMARY OF THE INVENTION

In accordance with the present invention, highly productive log handling equipment is provided which lifts logs from the ground and automatically feeds them to a log splitting station in synchronization with the log splitting cycles. This is accomplished by apparatus which includes a hydraulically powered log lifter operated by a control common with the log splitting mechanism. The log lifter is capable of pivoting from a position at which the outboard end thereof contacts the ground to an position at which the outboard end is elevated above horizontal. The log lifter is preferably manufactured as a two-framed skeletal structure. The lifter inner frame may be pivotally connected at its inboard end to the frame of a conventional log splitting machine for pivoting about an axis parallel to the direction of motion of the log splitting mechanism. The log lifter outer frame is pivotally connected to the outboard end of the inner frame. Cooperating block members on the inner and outer frames maintain the two frames in a generally planar configuration. However, when desired, the outer frame may be folded over onto the inner frame to save space, as when transporting the log splitting machine.

The outboard end of the outer frame is fabricated with an extension member which extends at an angle from the main portion of the frame. The angle is chosen such that when the log lifter is in the lower ground-contacting position the angled extension member lies substantially flat on the ground. In that position, a log may be easily rolled onto the angled member. When the log lifter is actuated toward the raised position, the log rolls along the lifter frames to the splitting station on the log splitting machine. To actuate the log lifter between the lowered and raised positions, an actuator, such as a hydraulic cylinder, may be pivotally connected between the log splitter frame and the log lifter inner frame. The cylinder is preferably connected to the log splitter frame below the pivotal connection between the log lifter inner frame and log splitter frame.

Further in accordance with the present invention, the log lifter operates in timed relationship to the log splitting cycles in a simple and efficient manner. This is achieved by means of a single three-position hydraulic valve for controlling both the log lifter and the log splitting mechanism. In one valve position, the valve directs the hydraulic fluid to advance the log splitting mechanism to split a log while simultaneously the log lifter is lowered to the ground for loading with an unsplit log. At the completion of the splitting and loading cycle, the valve is reversed. The log splitting mechanism then retracts, and the log lifter raises to the raised position. The log then rolls along the sloped log lifter frames to the splitting station. To prevent the log from rolling past the splitting station, one or more stops are secured to the log splitter frame on the opposite side of the log lifter.

Other objects, advantages and features of the invention will become apparent to those skilled in the art from the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
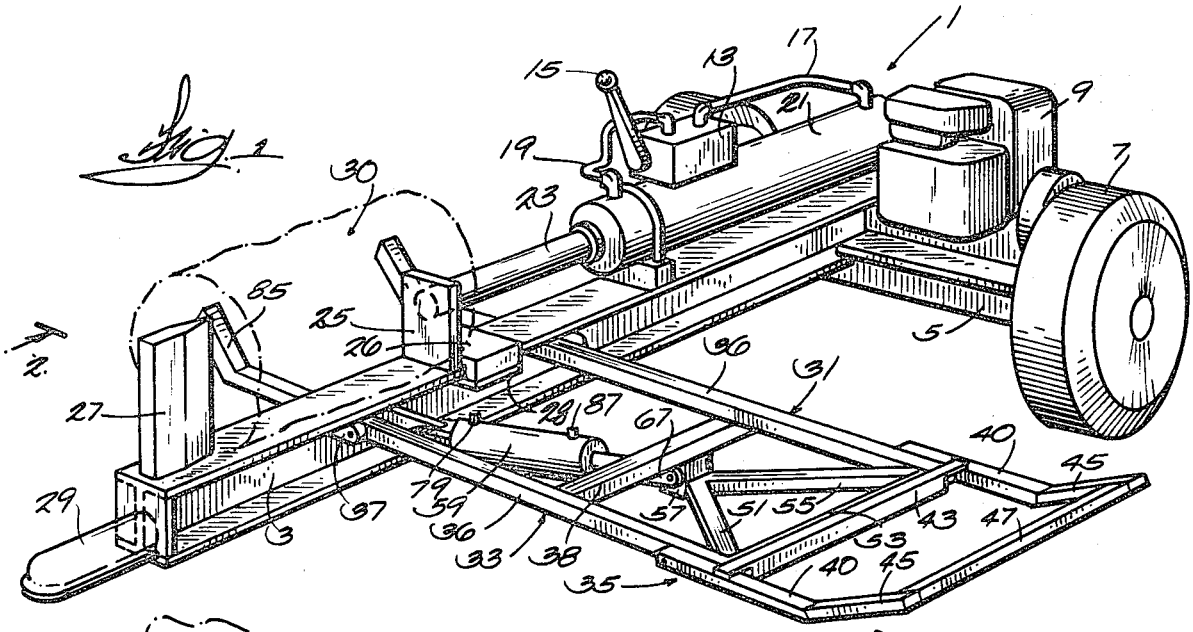
FIG. 1 is a perspective view of the log lifter of the present invention operatively mounted to a conventional log splitting machine.

Referring to FIG. 1, a log splitting machine 1 is illustrated which may advantageously be provided with the log lifter of the present invention.

The log splitting machine 1 includes a longitudinally extending frame 3 which may be in the general form of an I-beam. Extending from the rearward end of the frame 3 is a transverse frame 5. The ends of frame 5 are provided with conventional bearings, not shown, for mounting a pair of wheels 7. The transverse frame is also utilized to securely support a prime mover, such as internal combustion engine 9. The crankshaft of engine 9 is adapted to drive, in a well known manner, a hydraulic pump, not illustrated in FIG. 1 but indicated as reference numeral 11 in FIG. 3. The hydraulic fluid supplied by pump 11 is controlled by a four-way valve 13 through a manually operated control handle 15, FIGS. 1 and 3. The outlet ports of valve 13 are connected by lines 17 and 19 to opposite ends of a log splitting cylinder 21 which is mounted longitudinally to the frame 3. Extending from the cylinder 21 is a piston rod 23 to the end of which is attached a log pushing plate 25. The pushing plate 25 is guided along the frame 3 by a channel 26 and keeper plates 28. Mounted to the frame 3 in operational relationship to the pushing plate to create a splitting station 30 is a sharp log splitting wedge 27. To provide transportability to the log splitter 1, the forward end of the frame 3 may be provided with a standard hitch 29.

Figure 2:
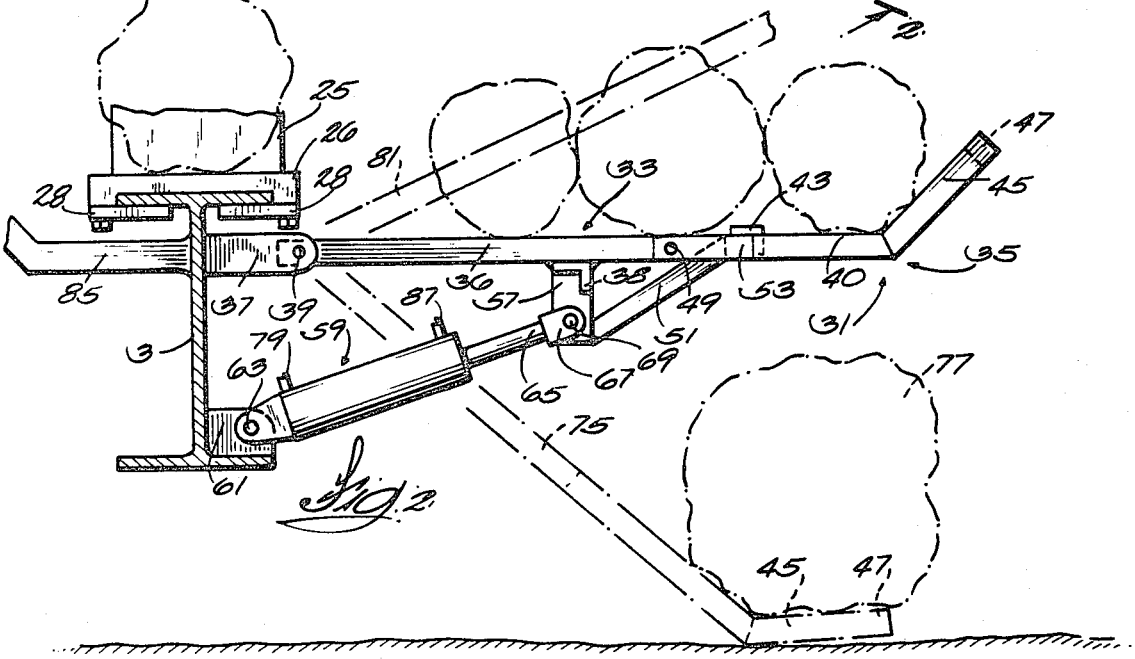
FIG. 2 is a cross-sectional view taken along lines 2—2 of FIG. 1.

In accordance with the present invention, a log lifter 31 is mounted to the frame 3 of the log splitting machine 1, FIGS. 1 and 2. In the preferred embodiment, the log lifter 31 comprises an inner frame 33 and an outer frame 35. As best shown in FIG. 2, the inner frame comprises a pair of elongate beams 36 connected by a cross brace 38. The beams 36 are connected to the log splitter frame 3 for pivotal motion about an axis parallel to the direction of the splitting motion of pushing plate 25. For that purpose, a pair of brackets 37 and pins 39 may be employed. Preferably, the frame 33 pivotal connection to the log splitting frame 3 is near the top of frame 3.

Outer frame 35 is fabricated as a pair of side beams 40 connected by a cross brace 43. The side beams 40 terminate in angled beams 45 which are joined by an end brace 47. Outer frame 35 is pivotally connected, as by pins 49, to the outboard end of inner frame 33. To maintain a substantially planar relationship between the beams 36 and 40, the outer frame includes a block device which, in the illustrated embodiment, is composed of three structural members 51, 53, and 55 joined into a triangular frame. Block member 53 is secured, as by welding, to the cross brace 43. The junction of block members 51 and 55 is flattened to contact a stop block 57 attached to the inner frame cross brace 38.

To raise and lower the frames 33 and 35, the log lifter 31 includes an actuator device, such as a hydraulic cylinder 59. In the particular log lifter illustrated, the cylinder is pivotally fastened, as by bracket 61 and pin 63, to the log splitting frame 3. Preferably, the cylinder pivotal connection is as low as possible on the frame 3. The end of the piston rod 65 of cylinder 59 may be provided with a clevis 67 for pivotal attachment through pin 69 to block 57.

Figure 3:
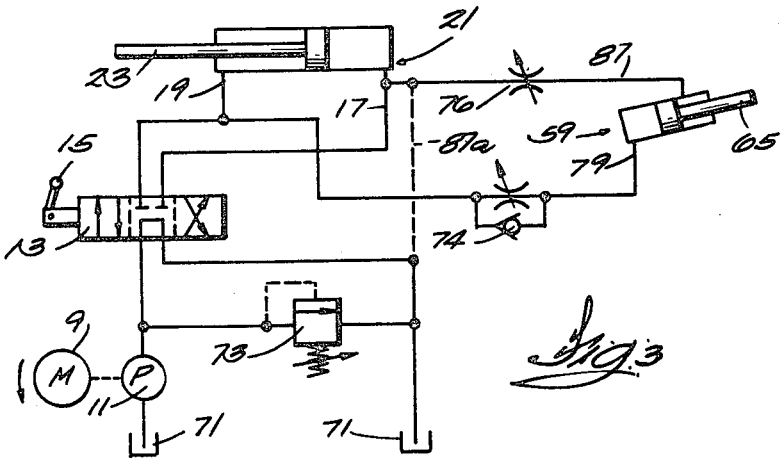
FIG. 3 is a schematic diagram of the hydraulic circuit for controlling the operation of the log splitting machine and log lifter.

Further in accordance with the present invention, the cylinders 21 and 59 are controlled by a single control valve 13. Single valve control is accomplished by means of the circuit illustrated schematically in FIG. 3. In FIG. 3, the circuit components are labeled, where appropriate, with reference numerals that correspond with the components also shown in FIGS. 1 and 2. Reference numeral 71 indicates the hydraulic reservoir; reference numeral 73 indicates a conventional relief valve; reference numeral 74 indicates a conventional flow-through reverse check valve; and reference numeral 76 indicates a conventional variable restrictor valve.

The operation of the log lifter of the present invention will be described in terms of a complete loading and splitting cycle. It will be assumed that the operator had previously positioned the handle 15 to displace the spool of valve 13 to the left with respect to FIG. 3. In that situation, the piston rod 23 is in the most extended position and has finished splitting a log. The log lifter actuator piston rod 65 is in the most retracted position. With the piston rod 65 retracted, the log lifter is in the lowered position, as indicated by the dashed lines 75 of FIG. 2. While in the lowered position, the angled beams 45 and end brace 47 rest on the ground. The operator may then easily roll a log 77 onto the angled beams and end brace without the necessity of lifting the log.

To start the loading cycle, the operator rotates the valve handle 15 such that the valve spool is displaced to the right in FIG. 3. The valve then directs the hydraulic oil through line 19 to retract piston rod 23 and pushing plate 25. Simultaneously, oil flows through line 79 and freely past check valve 74 to extend piston rod 65. As a result, when the pushing plate is retracted, the log lifter elevates toward an abovecenter position as depicted by dashed line 81, FIG. 2. The log 77 will eventually roll down the log lifter beams 36 and 40 to the splitting station 30 between the pushing plate and wedge 27. It is anticipated that the frames 35 and 33 need not be elevated more than 30° past horizontal for proper log unloading. To catch the log as it slides down the log loader, a pair of end stops 85 may be secured to the frame 3.

After the piston rod 23 is fully retracted and the log 77 is in place in the splitting station 30, the log may be split. For that purpose, the operator reverses the valve handle 15 to shift the valve spool to the left in FIG. 3. The oil from pump 11 then flows through line 17 to extend the piston and pushing plate against the log, thereby forcing the log against the wedge 27 for splitting. Simultaneously, the hydraulic oil flows through line 87 to retract the piston rod 65 and thus lower the log lifter frames. The return of the oil in the cylinder 59 to the reservoir 71 is controlled by the restrictor of valve 74, thus ensuring that the frames 35 and 33 lower safely. By completely closing the restrictor of valve 74 when the motor is not operating, the frames may be maintained at a horizontal or other desired position. That makes the log loader of the present invention convertible into a platform for storing logs ready to be split, for transportation, or for other purposes.

At the completion of the log splitting chores, the outer frame 35 may be folded counterclockwise as viewed in FIG. 2 onto the inner frame 33. That results in decreased lateral length of the log lifter, so that the log splitting machine 1 may be readily transported. Preferably, the lateral length of the folded log lifter does not extend beyond a wheel 7.

Thus, it is apparent that there has been provided, in accordance with the invention, a log lifter that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. For example, line 87*a* can be substituted for line 87 in FIG. 3 and the lifter frame will float to the ground rather than be powered to the ground.

I claim:

1. In combination with a log splitting machine having an elongated frame, a log splitting station defined by a cutting wedge mounted to the frame and by a first hydraulic splitting cylinder mounted to the frame and having a reciprocating piston adapted to push a log against the cutting wedge, a log lifter for feeding logs to the splitting station without manually lifting them from the ground, comprising:

(a) frame means extending laterally from and pivotally connected at a first end to the log splitting frame for rotation about an axis substantially parallel to the splitting cylinder longitudinal axis between a first ground-contacting position and a second elevated position, the frame means comprising:

i. an inner frame pivotally connected to the log splitting machine frame;

ii. an outer frame pivotally connected to the inner frame for selective folding onto the inner frame for compact transportation, the outer frame being formed with an angled member;

iii. a block secured to the inner frame; and iv. at least one structural member secured to the outer frame and adapted to abut the inner frame block to maintain a substantially planar relationship between the inner and outer frames as the inner frame rotates with respect to the log splitting frame when the outer frame is unfolded from the inner frame; and (b) a second hydraulic cylinder pivotally connected to the splitting machine frame and having a reciprocating piston pivotally connected to the block secured to the log lifter inner frame for pivoting the frame means between the ground-contacting position and the elevated position; and (c) hydraulic circuit means for controlling the first and second cylinders, so that an unsplit log may be rolled without manual lifting onto the outer frame angled member when the frame means is in the ground-contacting position and rolled to the splitting station by raising the frame means to the elevated position.

2. The combination of claim 1 wherein the hydraulic circuit means includes a common directional control valve for simultaneously controlling the first splitting cylinder and the second log lifter hydraulic cylinder.

3. The combination of claim 2 wherein the hydraulic circuit means is adapted to simultaneously retract the splitting cylinder piston and to extend the log lifter piston to raise the log lifter, and to simultaneously extend the splitting cylinder piston and retract the log lifter piston to lower the log lifter, so that the logs to be split are automatically fed to the splitting station in synchronization with the splitting cycle.

4. The combination of claim 3 wherein the hydraulic circuit means includes restrictor means for adjusting the speed with which the frame means is lowered and for maintaining the frame means permanently at a predetermined attitude when the hydraulic circuit is deenergized.

5. In combination with a log splitting machine having an elongated frame, a log splitting station defined by a cutting wedge mounted to the frame and by a first hydraulic splitting cylinder mounted to the frame and having a reciprocating piston adapted to push a log against the cutting wedge, a log lifter for feeding logs to the splitting station without manually lifting them from the ground, comprising:

(a) frame means extending laterally from and pivotally connected at a first end to the log splitting frame for rotation about an axis substantially parallel to the splitting cylinder longitudinal axis between a first ground-contacting position and a second elevated position, the frame means comprising:

i. a lift frame having a first section pivotally connected to the log splitting machine frame;

ii. said frame having a second outer frame section with upturned end; and (b) a second hydraulic cylinder pivotally connected to the splitting machine frame and having a reciprocating piston pivotally connected to the log lifter frame for pivoting the frame means between the ground-contacting position and the elevated position; and (c) hydraulic circuit means for simultaneously controlling the first and second cylinders, said circuit including valve means and a fluid conduit connecting and affording fluid communications between said valve means and said first and second cylinders, said valve means including single lever control means movable between first and second positions with said first cylinder being energized when said lever is being moved to said first position to cause splitting action of said wedge and when said lever is being moved to said second position said second cylinder is actuated to raise said inner and outer frame to feed a log to said splitting station, so that an unsplit log may be rolled without manual lifting onto the outer frame angled member when the frame means is in the ground-contacting position and rolled to the splitting station by raising the frame means to the elevated position.

* * * * *